United States Patent [19]

Chang

[11] Patent Number: 4,961,570

[45] Date of Patent: Oct. 9, 1990

[54] EXERCISING MECHANISM FOR SIMULATING CLIMBING A LADDER

[76] Inventor: Chester Chang, No. 1-5, Chun Ting Lane, Ya Tan Road, Ta Ya Hsiang, Taichung Hsien, Taiwan

[21] Appl. No.: 433,549

[22] Filed: Nov. 8, 1989

[51] Int. Cl.[5] ..... A63B 21/00

[52] U.S. Cl. ..... 272/73; 272/130

[58] Field of Search ..... 272/72, 96, 97, 70, 272/132, 73; 128/25 R; D21/194; 74/48, 665 GE

[56] References Cited

U.S. PATENT DOCUMENTS 4,657,244 4/1987 Ross ..... 272/73
4,708,128 11/1987 Ancillotti ..... 272/73
4,712,789 12/1987 Brilando ..... 272/73
4,712,790 12/1987 Szymski ..... 272/73
4,798,379 1/1989 Jenkins ..... 272/70
4,838,544 6/1989 Sasakawa et al. ..... 272/73

*Primary Examiner*—Stephen R. Crow
*Attorney, Agent, or Firm*—Merchant, Gould, Smith, Edell, Welter & Schmidt

[57] ABSTRACT

An exerciser includes a frame body, a wheel pivotally provided on one end of the frame body, a driving mechanism including a rocker arm pivoted on each side of the frame body, and a transmission mechanism being coupled between the wheel and the driving mechanism. The wheel is actuated to rotate by an up and down movement of a free end of each rocker arm.

2 Claims, 4 Drawing Sheets

EXERCISING MECHANISM FOR SIMULATING CLIMBING A LADDER

BACKGROUND OF THE INVENTION

The present invention relates to an exerciser, and more particularly to an exerciser which is good for training for climbing up a mountain or a ladder.

Many varieties of exericers are widely used nowadays. Many of the exercisers are exercising bicycles which are suitable for training for riding a bicycle. No exercisers are thus provided for training for climbing up a mountain or a ladder.

SUMMARY OF THE INVENTION

The primary objective of the present invention is to provide an exerciser which is suitable for a user to train for climbing up a mountain or a ladder.

According to one embodiment of the present invention, an exerciser includes a frame body; a wheel pivotally provided on one end of the frame body; a driving mechanism including a rocker arm pivoted on each side of the frame body, a crank pivoted on the frame body and a driving gear being fixed on a crank shaft of the crank; and a transmission mechanism being coupled between the wheel and the driving gear of the driving mechanism. The wheel is actuated to rotate by an up and down movement of a free end of each rocker arm.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
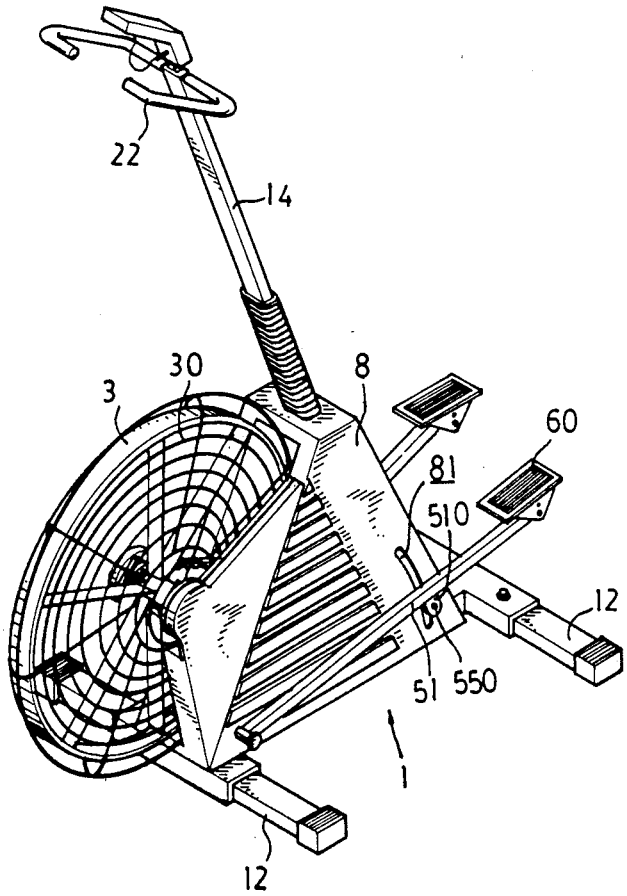
FIG. 1 is a perspective view of an exerciser in accordance with the present invention.
Figure 2:
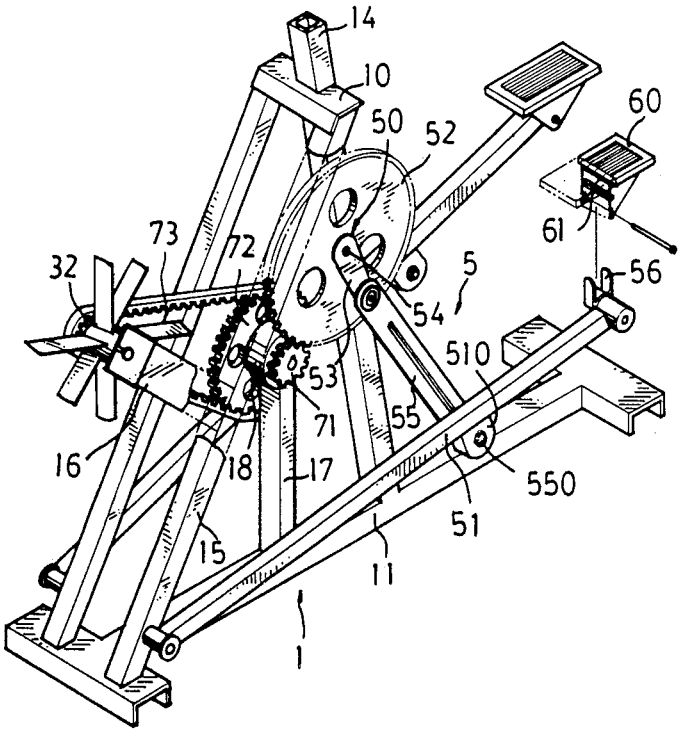
FIG. 2 is a partial exploded view of the exerciser of FIG. 1, in which a cover is removed.
Figure 3:
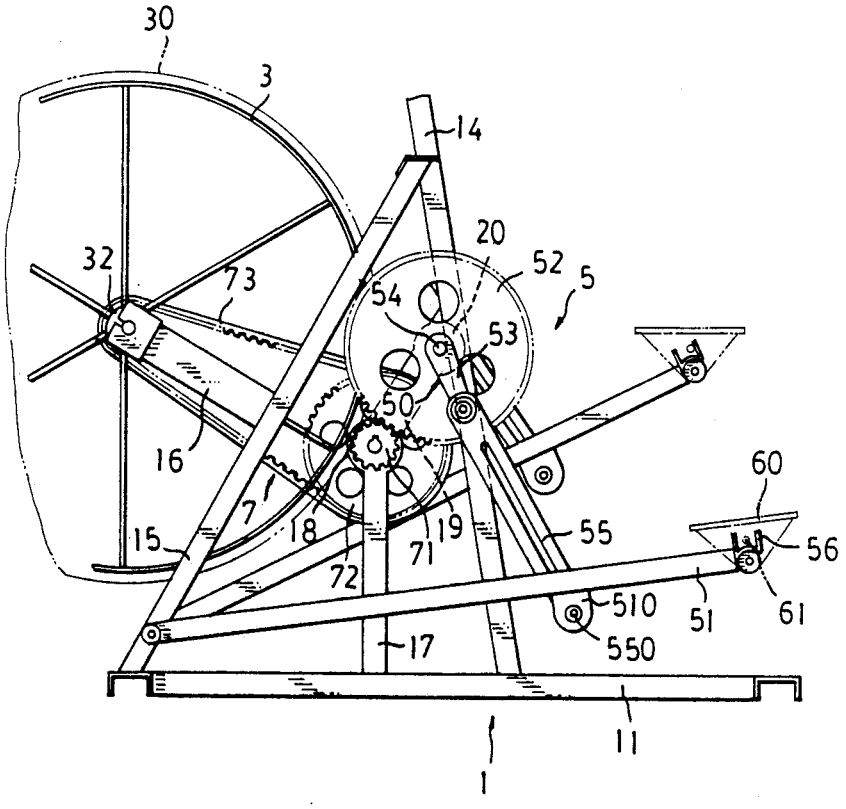
FIG. 3 is a side elevational view of the exerciser with the cover removed.

Referring to the drawings and initially to FIGS. 1, 2, and 3, the exerciser in accordance with the present invention comprises generally a frame body 1, a wheel 3 rotatable on the frame body 1, a driving mechanism 5 including a rocker arm 51 pivoted on each side of the frame body 1, and a transmission mechanism 7 being coupled between the wheel 3 and the driving mechanism 5.

The frame body 1 has a substantially I-shaped base portion 11 which has four extendible feet 12. A main bar 14, which is inclined from vertical in a longitudinal direction relative to the frame body 1, is disposed on a central portion of the base portion 11. A lower end of each of a pair of supporting rods 15 is fixed on one end of the base portion 11 and an upper end of each supporting rod 15 is fixed on a middle portion of the main bar 14 via a lateral bar 10. An extension plate 16 is disposed on a middle portion of each supporting rod 15 and extends outward from the frame body 1. A vertical post 17 is disposed on the base portion 11 and is substantially located between the main bar 14 and the supporting rods 15. A first sleeve 18 with an internal bearing is disposed on top of the vertical post 17. A second sleeve 20 with an internal bearing is fixed onto the main bar 14 and a reinforced rod 19 is fixed between the first sleeve 18 and the second sleeve 20 as shown in dotted lines in FIG. 3. A handle 22 is provided on top of the main bar 14. The wheel 3 with a pinion 32 is pivotally supported on two free ends of the extensioin plates 16. A mesh cover 30 is fixed on the two free ends of the extension plates 16 for accomodating the wheel 3 in order to avoid injury to the users, The driving mechanism 5 includes the rocker arms 51, a driving gear 52, a crank 50 having two arms 53 and a pair of coupling rods 55. One end of each rocker arm 51 is pivoted on a lower end of the respective supporting rod 15. A lug 510 is disposed on a lower surface of each rocker arm 51. A crank shaft 54, which is an intermediate portion of the crank 50 joining the two crank arms 53, is pivotally supported on the second sleeve 20. The driving gear 52 is rigidly fixed on the crank shaft 54 of the crank 50 so that the driving gear 5i rotates with the crank 50. A coupling rod 55 is connected between a free end of each crank arm 53 and the lug 510 of each rocker arm 51 via pivot pin 550. The pivot pin 550 is pivotally connected between the lug 510 of each roker arm 51 and the respective coupling rod 55. A pair of stop plates 56 are provided on a free end of each rocker arm 51. A pedal 60 with a stop rod 61 laterally provided therein is pivoted on a free end of each rocker arm 51 and is arranged so that the stop rod 61 is laid between the stop plates 56. The stop plates 56 limit the rotation of each pedal 60.

The transmission mechanism 7 includes a driven gear 71 pivotally supported on the first sleeve 18, an intermediate gear 72 rigidly fixed to the driven gear 71, the intermediate gear 72 and the driven gear 71 are preferably coaxial, and a belt 73 coupled between the pinion 32 and the intermediate 72. The driving gear 52 engages and drives the driven gear 71.

As shown in FIG. 1, a cover 8 is provided to enclose the lower portion of the frame body 1, especially to enclose the gears 32, 52, 71 and 72 in order to avoid injury to the users. A curved slot 81 is provided on each side of the cover 8 corresponding to the pivot pin 550 for the respective coupling rod 55.

Figure 4:
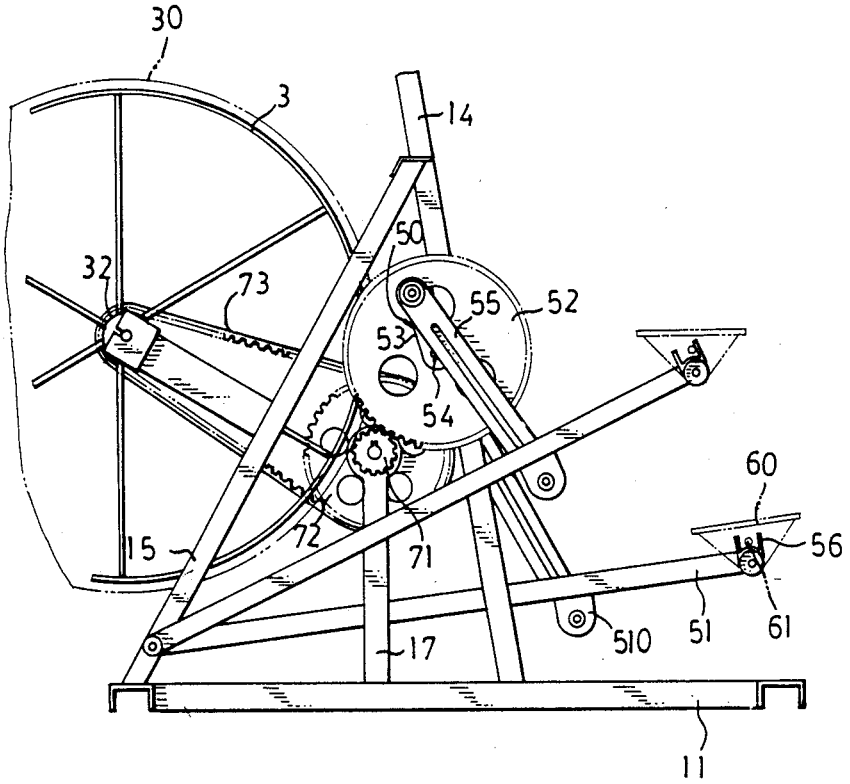
FIG. 4 is a side elevational view similar to FIG. 3, illustrating a movement of a transmission mechanism of the exerciser of FIG. 1.

Referring next to FIGS. 3, and 4, the driving gear 52 is driven to rotate by an up and down movement of the rocker arms 51. The driving gear 52 drives the driven gear 71 and the intermediate gear 72 so that the wheel 3 is driven to rotate through the belt 73 and the pinion 32.

Alternatively, the driving gear 52 and the driven gear 71 can be substituted by a chain gearing. Similarly, the pinion 32 and the intermediate gear 72 can be substituted by a chain gearing.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercising mechanism comprising generally a frame body having a handle provided on a top end thereof; a resistance wheel rotatably provided on said frame body; a driving mechanism including a pair of rocker arms pivoted on each side of said frame body, a crank having two crank arms being pivotally provided on said frame body, a driving gear fixed onto a crank shaft of said crank, coupling rod being pivotally connected between a free end of each said crank arm and each said rocker arm so that said driving gear is actuated to rotate by an up and down movement of a free end of each said rocker arm; a transmission mechanism being coupled between wheel and said driving mechanism; said transmission mechanism including a driven gear rotatably provided on said frame body for engagement with said driving gear of said driving mechanism, an intermediate gear being fixed to and coaxial with said driven gear, a pinion fixed onto an axle of said wheel, and a coupling element being coupled between said pinion and said intermediate gear; so that a user of said exercising mechanism may step on said free ends of said rocker arms so as to simulate climbing up a ladder.

2. An exercising mechanism comprising generally a frame body having a handle provided on a top end thereof; a resistance wheel rotatably provided on said frame body; a driving mechanism including a pair of rocker arms pivoted on each side of said frame body, a crank having two crank arms being pivotally provided on said frame body, a driving gear fixed onto a crank shaft of said crank, a coupling rod being pivotally connected between a free end of each said crank arm and each said rocker arm so that said driving gear is actuated to rotate by an up and down movement of a free end of each said rocker arm; a transmission mechanism being coupled between said wheel and said driving mechanism; a foot pedal with a stop rod laterally provided therein being pivotally provided on a free end of each said rocker arm where a pair of stop plates are provided; said stop rod of said pedal being provided between said stop plates so that a rotation of said stop rod is limited by said stop plates; and so that a user may step on said foot pedals so as to simulate climbing up a ladder.

* * * * *